US008485395B2

(12) United States Patent
Ciavarella et al.

(10) Patent No.: US 8,485,395 B2
(45) Date of Patent: Jul. 16, 2013

(54) DISPENSER LOCKOUT MECHANISM

(75) Inventors: Nick E. Ciavarella, Seven Hills, OH (US); David D. Hayes, Wooster, OH (US)

(73) Assignee: GOJO Industries, Inc., Akron, OH (US)

( * ) Notice: Subject to any disclaimer, the term of this patent is extended or adjusted under 35 U.S.C. 154(b) by 138 days.

(21) Appl. No.: 13/195,990

(22) Filed: Aug. 2, 2011

(65) Prior Publication Data

US 2013/0032613 A1 Feb. 7, 2013

(51) Int. Cl.
*B67B 1/00* (2006.01)
*B67D 7/06* (2010.01)

(52) U.S. Cl.
USPC ..... 222/153.13; 222/153.01; 222/325; 222/181.3; 222/182

(58) Field of Classification Search
USPC ..... 222/153.01–153.04, 153.09, 153.13, 222/181.1–181.3, 182, 325; 221/154, 197, 221/287
See application file for complete search history.

(56) References Cited

U.S. PATENT DOCUMENTS

| | | | | |
|---|---|---|---|---|
| 6,619,512 | B1 | 9/2003 | Sayers et al. | |
| 7,066,356 | B2 | 6/2006 | Schuman et al. | |
| 7,086,567 | B1 * | 8/2006 | Ciavarella et al. | 222/95 |
| 7,621,426 | B2 * | 11/2009 | Reynolds et al. | 222/325 |
| 7,815,074 | B2 * | 10/2010 | Ciavarella et al. | 222/153.09 |
| 8,230,888 | B2 * | 7/2012 | Crossdale et al. | 141/18 |
| 2011/0056987 | A1 * | 3/2011 | Proper et al. | 222/153.13 |

* cited by examiner

*Primary Examiner* — Kevin P Shaver
*Assistant Examiner* — Nicholas J Weiss
(74) *Attorney, Agent, or Firm* — Renner Kenner Greive Bobak Taylor & Weber

(57) ABSTRACT

A product dispensing system includes a locking mechanism to prevent actuation of the system absent an authorized product refill unit. More specifically, the dispensing system includes a housing and an actuator slidably secured within the housing and including at least one locking post extending therefrom. The actuator is adapted to actuate a pump to cause dispensing of a product. A release ring is rotatably secured within the housing and includes at least one locking post extending therefrom and aligned with the locking post of the actuator. The release ring also includes at least one ramped surface. The locking posts of the actuator and release ring engage one another in a locked position to prevent actuation of the dispensing system, and the release ring is adapted to be rotated to an unlocked position upon insertion of an authorized refill unit.

17 Claims, 9 Drawing Sheets

DISPENSER LOCKOUT MECHANISM

FIELD OF THE INVENTION

The present invention relates generally to a product dispenser lockout mechanism. More particularly, the present invention relates to a pushbar lockout mechanism that prevents movement of an actuating pushbar absent an authorized refill unit positioned within the product dispenser.

BACKGROUND OF THE INVENTION

It is well known to provide fluid dispensers for use in restaurants, factories, hospitals, bathrooms and the home. These dispensers may contain one of a number of products such as, for example, soap, anti-bacterial cleansers, disinfectants, lotions and the like. The dispensers may include some type of pump actuation mechanism where the user pushes or pulls a lever to dispense a quantity of fluid, as is known in the art. Alternatively, "hands-free" automatic dispensers may also be utilized where the user simply places one or both hands underneath a sensor and a quantity of fluid is dispensed. Similar types of dispensers may be used to dispense powder or aerosol materials.

Product dispensers are commonly configured to be mounted on to a wall or other vertical surface, with the product being dispensed from an outlet near the bottom of the dispenser. It is also known that dispensers may be integrated into a countertop near a sink basin, with certain components of the dispensing system being located beneath the countertop, and other components, including an outlet, being located above the countertop. These types of dispensers are often referred to as counter-mount dispensing systems. Various other configurations of dispensers are also known, including table-top style dispensers that rest on a horizontal surface such as a counter or table top, or stand mounted dispensing systems that attach to a mounting pole.

Dispensers may directly hold a quantity of product, but these bulk fill dispensers have been found to be both messy and difficult to service. Bulk fill systems may also pose contamination and health concerns. As a result, refill units or containers that hold a quantity of fluid and provide a pump and nozzle mechanism have become increasingly popular. The sanitary refill units or containers are advantageous in that they are easily installed and replaced and create virtually no mess.

For varying reasons, manufacturers of product dispensers and refill units commonly wish to control the type of refill put in a dispenser. It is often of concern that the correct refill unit (type of product, concentration, product form, etc.) is put in the correct dispenser housing. In many cases, installing the correct refill unit is crucial to the customer. For example, it is imperative to hospital personnel to have anti-bacterial soap dispensed in a pre-surgical cleaning area, rather than another fluid such as, for example, moisturizing lotion. Therefore, manufacturers often provide keyed nozzle and pump mechanisms for each type of fluid refill unit so that only the appropriate refill unit can be installed in corresponding fluid dispensers. Manufacturers and associated distributors also rely upon keying systems to ensure that the dispensers can only be refilled with their own products and not products that may be inferior or have poor quality.

Conventional mechanical keying systems typically include a key projecting from one of the refill unit or the dispenser housing, and a keyway in the other adapted to receive the key. Insertion of the refill unit into the dispenser is prevented unless the key and keyway match. While these types of keying systems have proven somewhat successful, they also suffer from several disadvantages. The keys, in many cases, may simply be broken off or otherwise removed to bypass the keying system, especially where a competitor product is being used. In addition, the materials used to form the keys often allow the incorrect key to deform enough to fit within a dispenser. Furthermore, once the keying mechanism is bypassed to allow the refill unit to be fully inserted into the housing it operates as intended, with no further obstacles to overcome.

Thus, there is a need for an improved keying system for dispensers that alleviates one or more of the disadvantages of the prior art.

SUMMARY OF THE INVENTION

In general, a dispensing system according to the present invention includes a housing: an actuator slidably secured within the housing and including at least one locking post extending therefrom, the actuator adapted to actuate a pump to cause dispensing of a product; and a release ring rotatably secured within the housing and including at least one locking post extending therefrom and aligned with the locking post of the actuator, and at least one ramped surface, wherein the locking posts of the actuator and release ring engage one another in a locked position to prevent actuation of the dispensing system, and where the release ring is adapted to be rotated to an unlocked position upon insertion of an authorized refill unit.

In accordance with at least one aspect of the present invention, a dispensing system includes a housing; an actuator movably secured within the housing and having a locking post extending therefrom, the actuator adapted to actuate a pump to cause dispensing of a product; a release ring rotatable between a locked position and an unlocked position, the release ring including a locking post extending therefrom that is aligned with the locking post of the actuator in a locked position, and a ramped surface; and a collar of a refill unit including a ramped surface that, upon insertion into the housing, engages the ramped surface of the release ring to cause rotation of the release ring from a locked position to an unlocked position.

In accordance with at least one aspect of the present invention, a dispensing system includes a refill unit having a product reservoir, a pump, and a generally cylindrical collar, the collar including a ramped surface on an outer surface that is adapted to engage a rotatable release ring in a housing to unlock the dispensing system.

BRIEF DESCRIPTION OF THE DRAWINGS

For a full understanding of the invention reference should be made to the following detailed description and the accompanying drawings, wherein.

DETAILED DESCRIPTION OF THE ILLUSTRATIVE EMBODIMENTS

Figure 1:
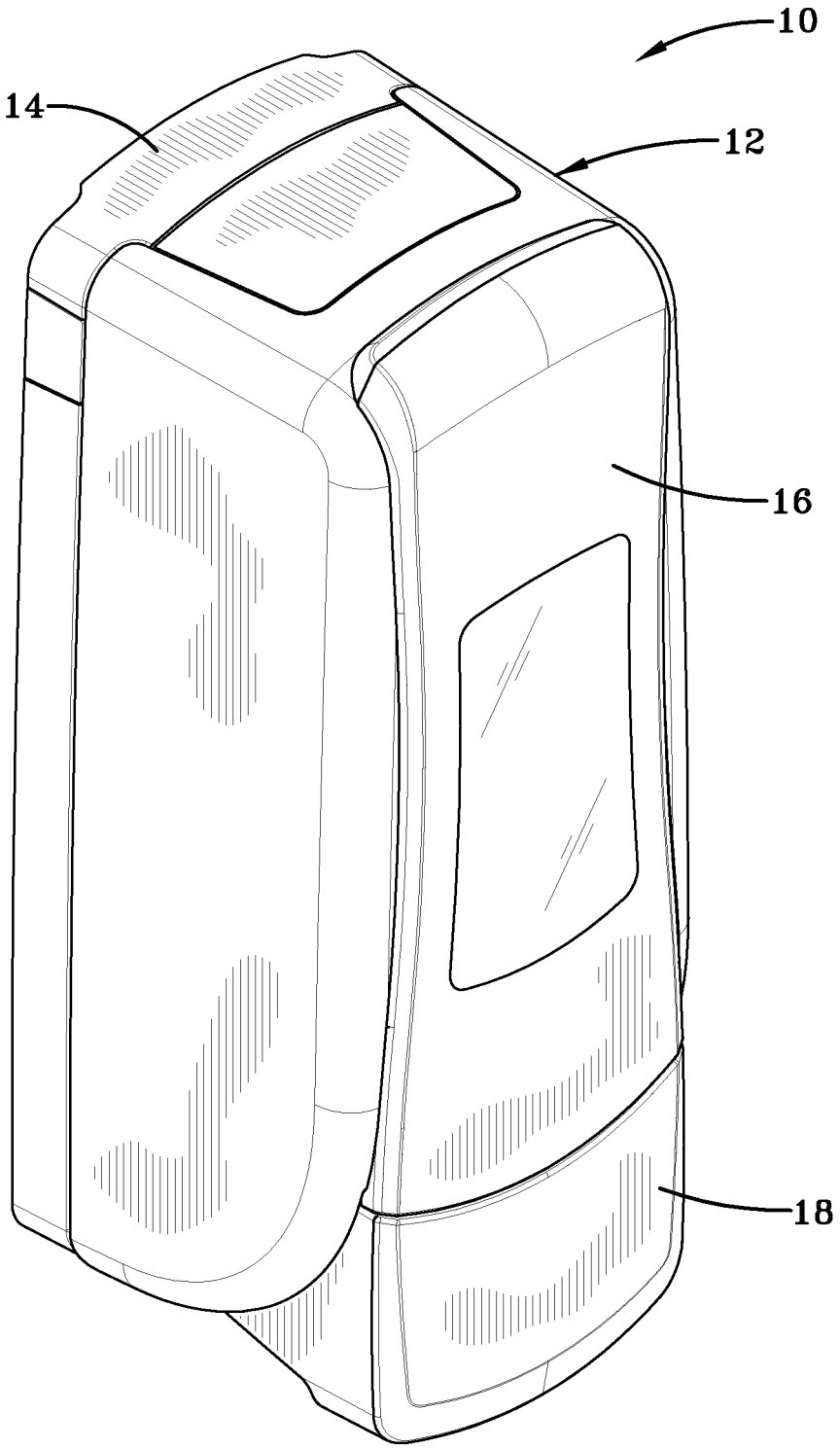
FIG. 1 is perspective of a dispensing system according to the concepts of the present invention.
Figure 2:
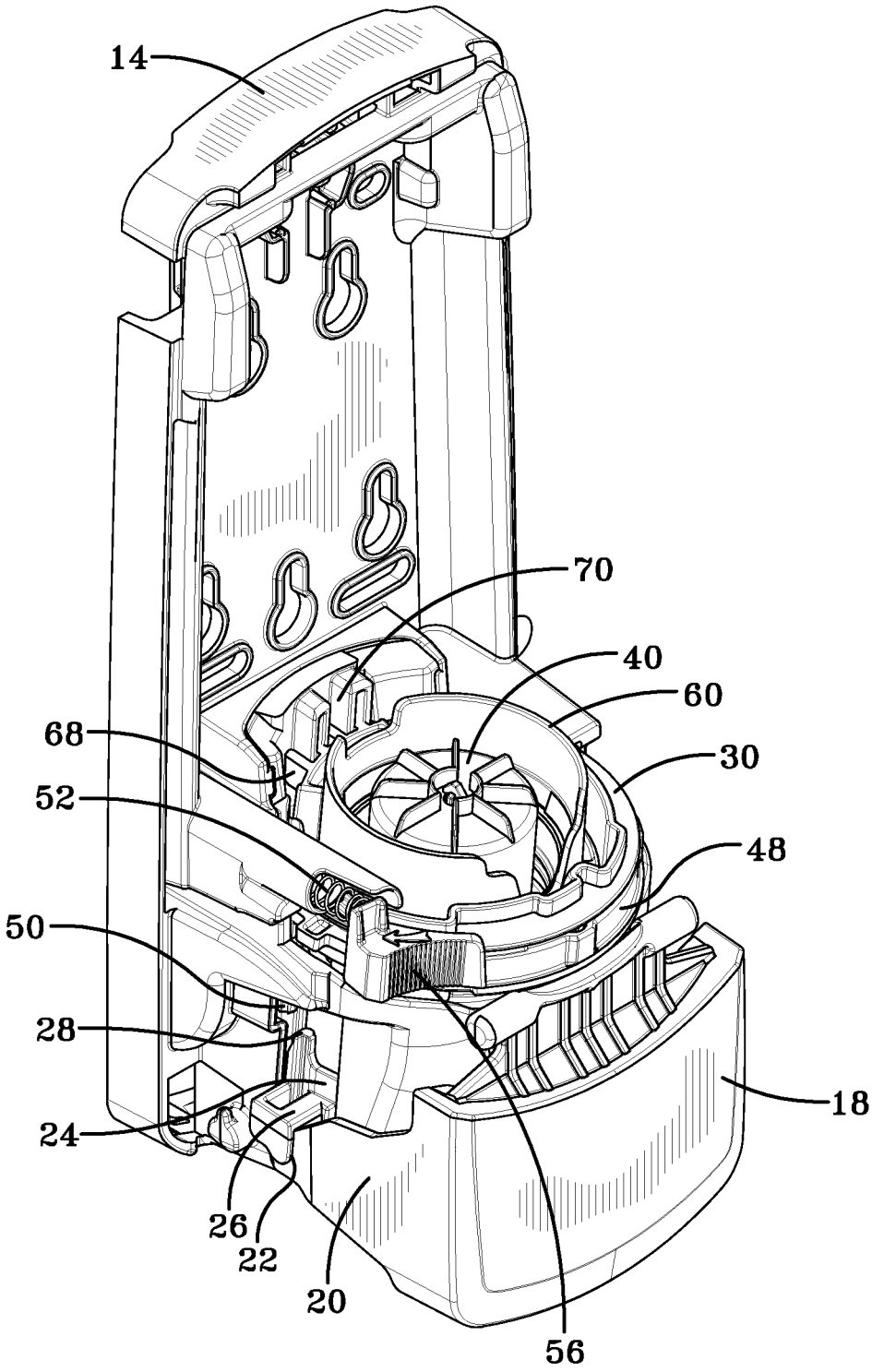
FIG. 2 is a perspective view of the dispensing system with the housing cover and product reservoir removed to show the internal components of the invention.
Figure 3:
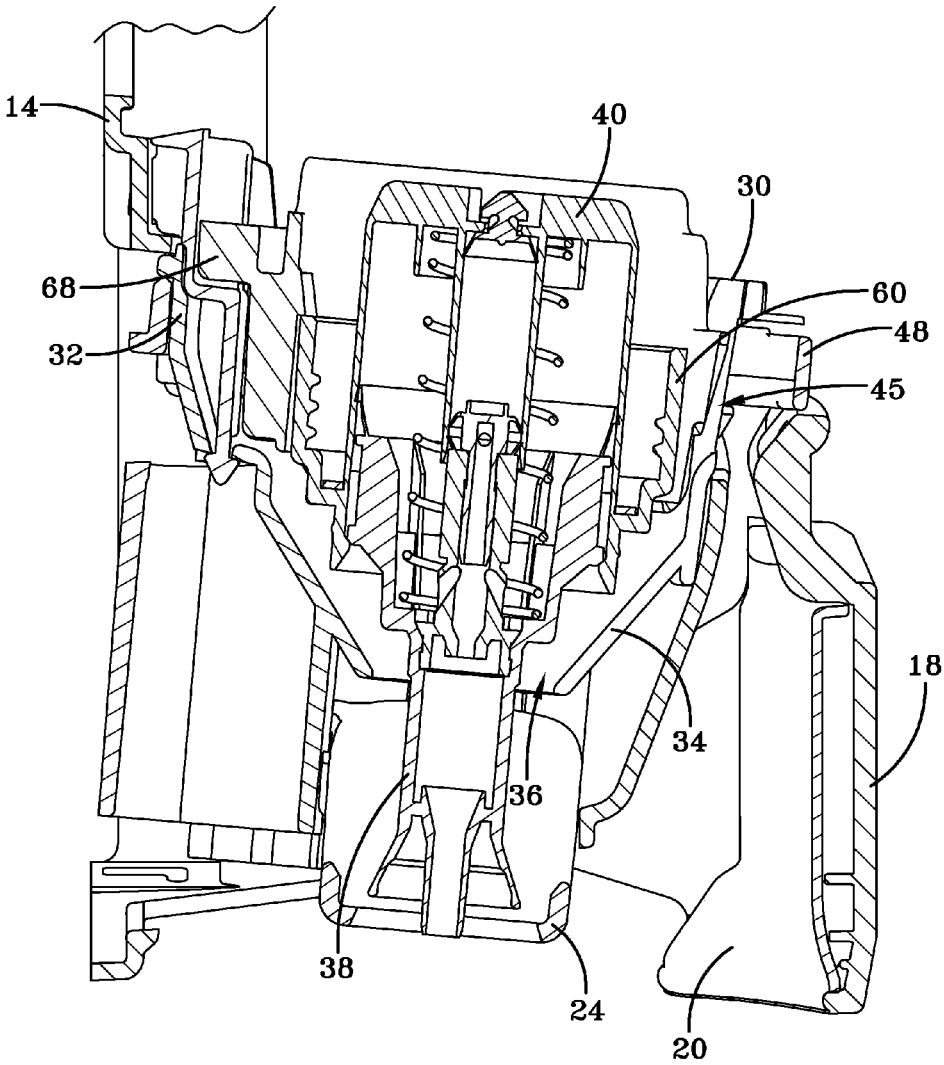
FIG. 3 is a fragmentary section view of the dispensing system of the present invention.

A primary concern in the field of fluid dispensing systems is the ability to prevent unauthorized refill units from being installed in a manufacturer's dispenser or in dispensers serviced by a distributor authorized by the manufacturer. The dispensing system disclosed herein fills this need by providing a lockout mechanism that prevents movement of a pushbar, and by providing the collar of a refill unit with the key that unlocks the pushbar to allow dispensing. Notably, the pushbar is prevented from moving unless a refill unit collar having the correct key is positioned within the dispenser.

Referring now to FIGS. 1-9, a dispensing system is shown and is generally indicated by the numeral 10. The dispensing system 10 includes a housing 12 which encloses and protects the internal components of the dispensing system 10. The housing 12 includes a back plate 14 adapted to be secured to a vertical surface, and a cover 16 that is pivotable or movable relative to the back plate 14. The cover 16 allows access to the internal components of the dispensing system 10 to facilitate replacement of a refill unit. A latching mechanism (not shown) secures the cover 16 to the back plate 14 during normal operation of the dispensing system 10, and is releasable to allow movement of the cover 16 relative to the back plate 14.

A pushbar 18 is provided and is pivotable about a horizontal axis to actuate the dispenser. The pushbar 18 is located at a bottom of the front of the housing 12. Such pivoting pushbars are well known in the art, and the particular structure and hinge mechanism utilized should not limit the invention, unless so claimed. The pushbar 18 includes a pair of laterally spaced rearwardly extending arms 20 (FIG. 2) that each form a radiused shoulder 22. The radiused shoulders 22 are adapted to engage an actuator 24 that is vertically movable within the housing 12 to cause actuation of a pump. The actuator 24 includes laterally extending legs 26 on each side, each leg 26 having a radiused outer surface. The radiused outer surface of the legs 26 engage the radiused shoulders 22 of the pushbar 18 to convert the pivoting motion of the pushbar 18 into vertical motion of the actuator 24.

The actuator 24 also includes a plurality of locking posts 28 extending upwardly therefrom. In the embodiment shown in the drawings two locking posts are provided, one adjacent to each of the legs 26. It is contemplated, however, that more than two locking posts may extend upwardly from various locations on the actuator 24. In certain embodiments, the plurality of locking posts may be equally spaced so as to align with posts on an annular release ring, as will be discussed below. In certain embodiments, the locking post 28 and the legs 26 may be formed integrally with the actuator 24. The locking posts 28 may have any desired shape or configuration, and the invention should not be limited by the particular shape and size of the locking posts 28 depicted in the drawings.

Figure 7:
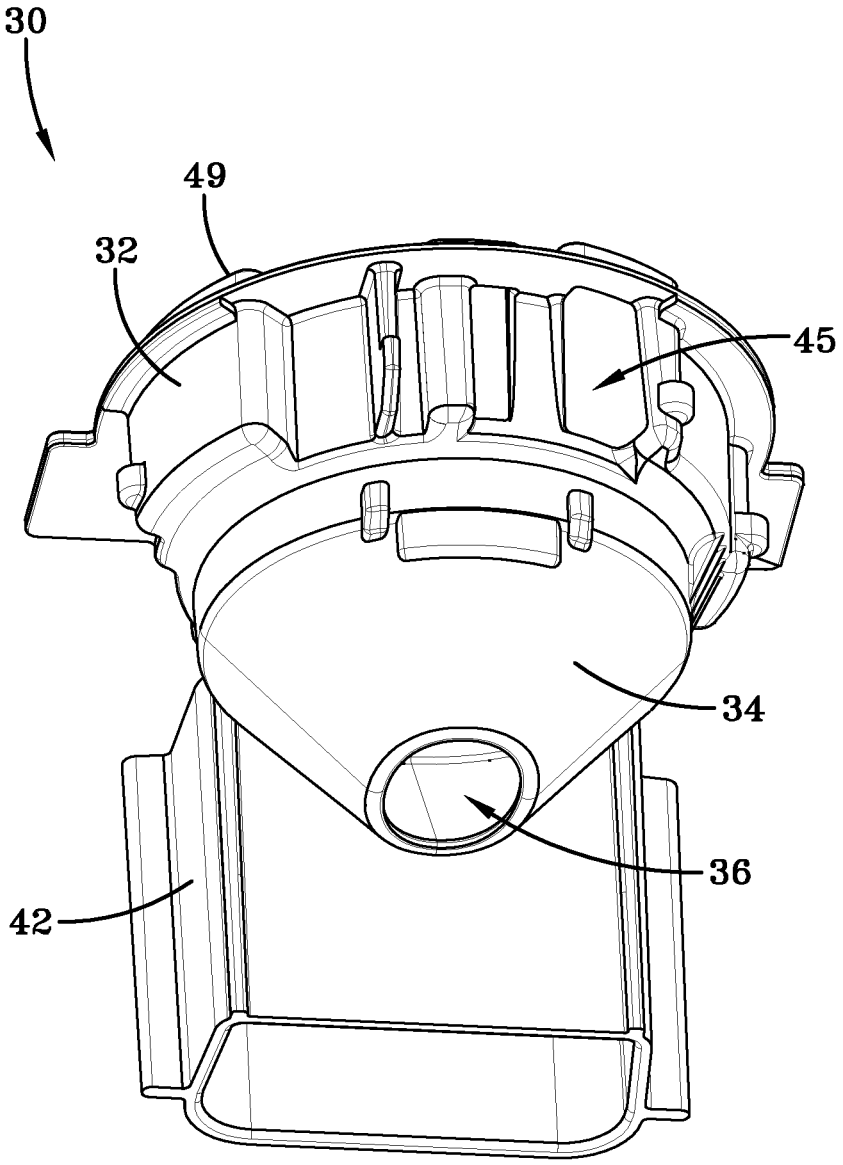
FIG. 7 is a bottom perspective view of a support member according to the concepts of the present invention.

The backplate 14 of the housing 12 carries a support member 30 that receives the pump portion of a refill unit therein, and supports the refill unit and dispenser components. The support member 30 includes a generally cylindrical upper portion 32 and a generally conical lower portion 34 having an opening 36 at a bottom thereof (FIG. 7). As will be appreciated by those skilled in the art, a refill unit may be received in the support member 30 with a piston 38 (FIGS. 3-5) extending through the opening 36 to contact and engage the actuator 24. In certain embodiments, the piston 38 may be part of a reciprocating piston pump 40 where upward movement of the piston causes dispensing of a product, and a downward return stroke of the piston causes priming of the pump.

Figure 4:
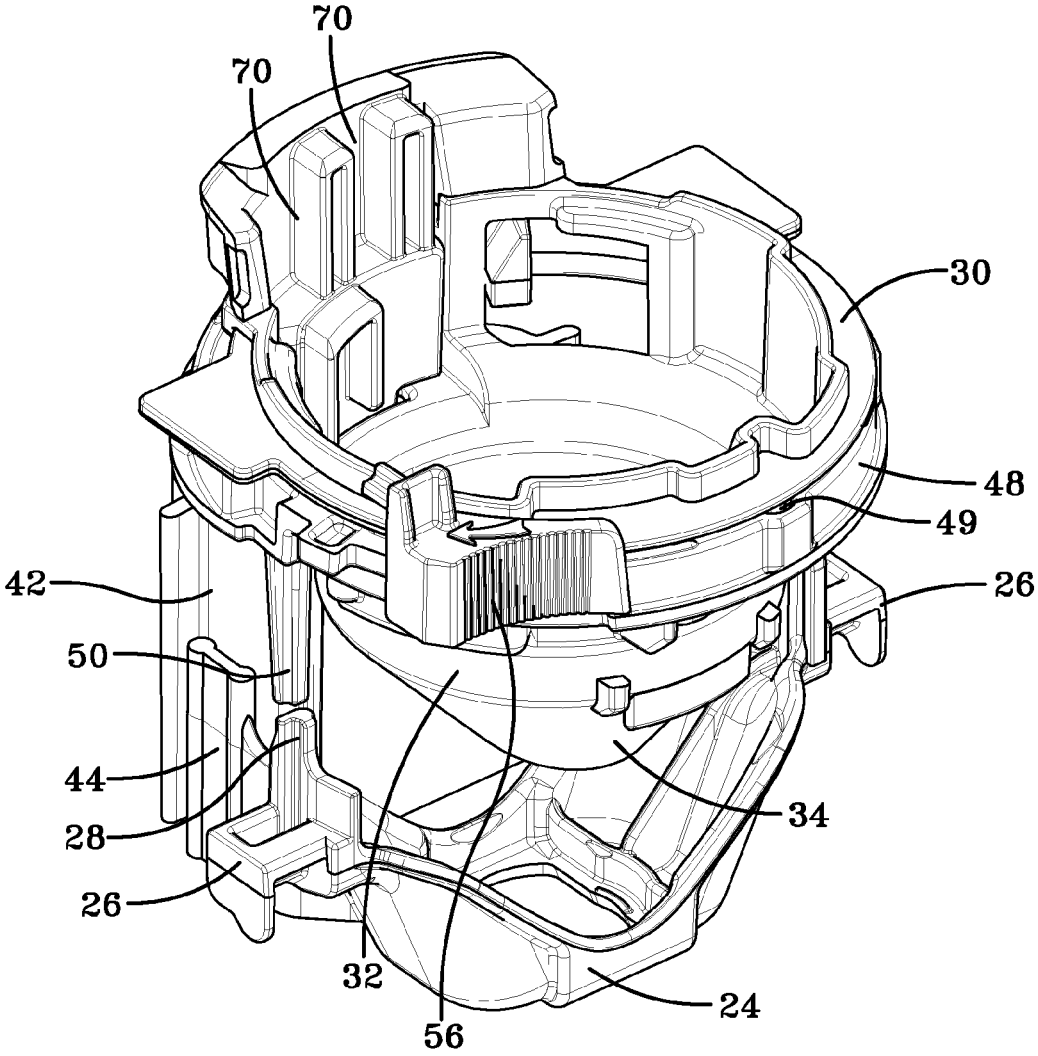
FIG. 4 is a perspective view of a sub-assembly including the locking mechanism of the dispenser system of FIG. 1 in a locked position absent insertion of a refill unit.
Figure 5:
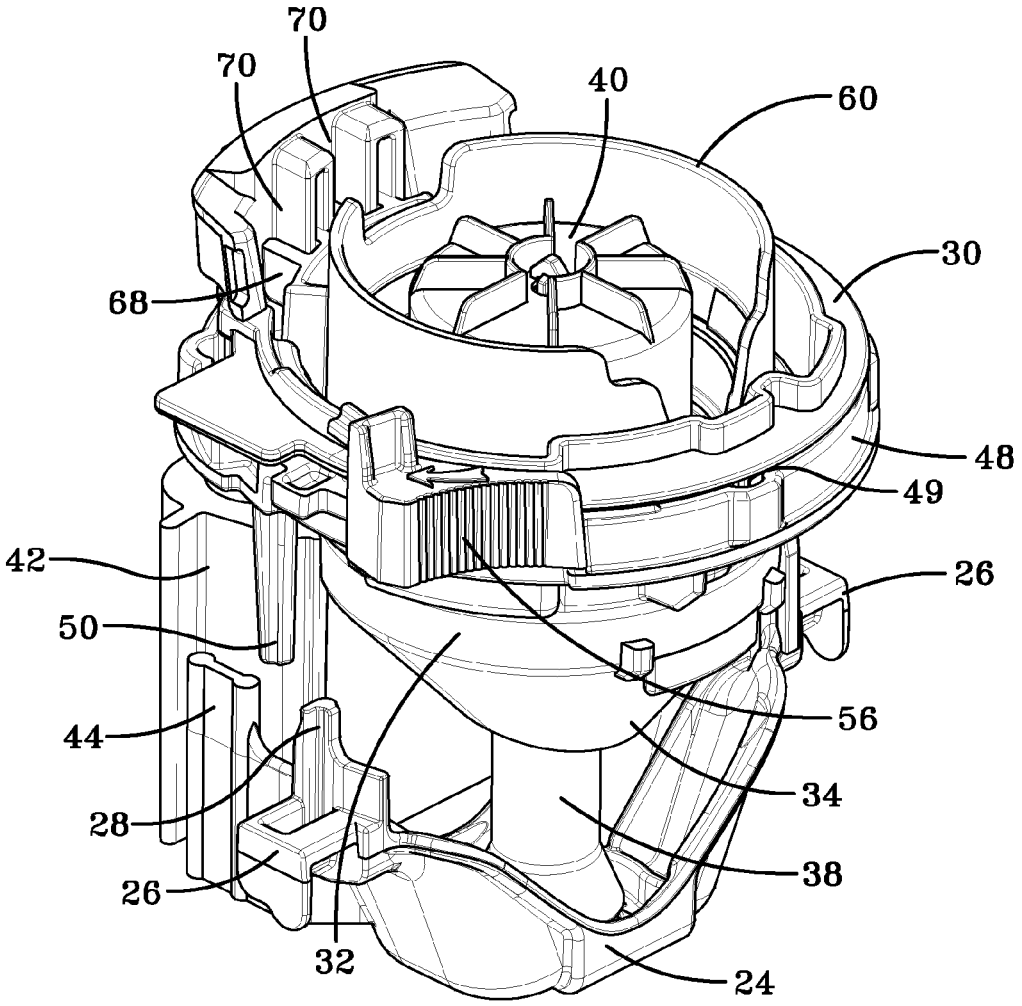
FIG. 5 is a perspective view of the sub-assembly of FIG. 4 in an unlocked position with a collar of a refill unit inserted into the dispenser.
Figure 6:
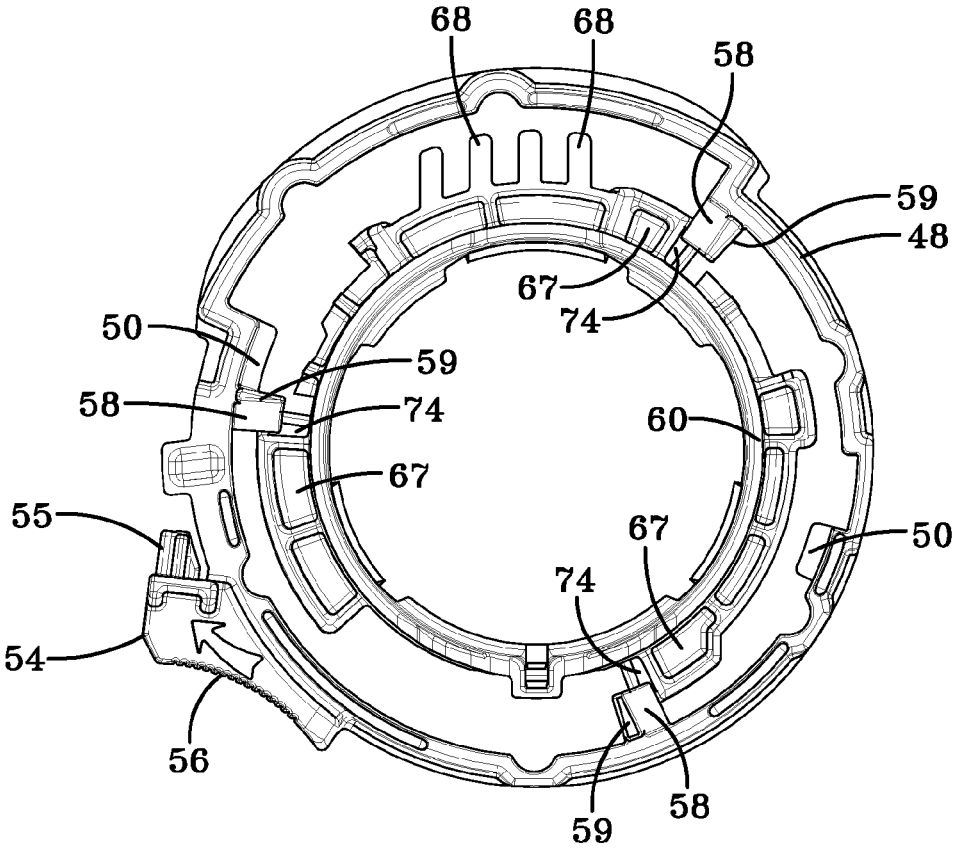
FIG. 6 is a top plan view of a sub-assembly including the lock ring and collar of the locking mechanism according to the concepts of the present invention.

In certain embodiments, a channel 42 may be formed by an exterior of the support member 30 and the housing 12 to receive vertical sliding members 44 of the actuator 24 (FIGS. 4 and 5). The vertical sliding members 44 are movable within the channels 42 to allow vertical motion of the actuator 24. In addition, the support member 30 may include a plurality of windows 45 spaced around the generally cylindrical upper portion 32. The windows 45 provide an opening from an exterior of the support member 30 to the interior of the support member to allow interaction of the components of the locking mechanism, as will be appreciated from the description to follow.

A release ring 48 is rotatably secured around the upper portion 32 of the support member 30. The release ring 48 is generally annular and is rotatable relative to the support member 30. A radial recess 49 may be provided in the upper portion 32 of the support member 30 to retain the release ring 48 in position. The release ring 48 includes a plurality of locking posts 50 equal to the number of locking posts 28 extending from the actuator 24. In the embodiment shown in the drawings two diametrically opposed locking posts 50 are provided extending downwardly from the release ring 48. The number and spacing of the locking posts 50 is dependent upon the number and spacing of the locking posts 28 on the actuator 24, as each locking post 50 on release ring 48 is aligned with a locking post 28 on actuator 24.

A biasing spring 52 is positioned between the backplate 14 of the housing 12 and a spring bracket 54 (FIG. 8) on the release ring 48. The spring bracket 54 may extend generally radially outwardly from the release ring 48, and may include a pin portion 55 adapted to receive the spring 52 thereon. The biasing spring 52 biases the release ring 48 in a locked position, while allowing rotation of the release ring 48 from the locked position to an unlocked position when the biasing force is overcome. A push tab 56 may also be provided adjacent to the spring bracket 54, as shown in the drawings, or elsewhere on the release ring 48. The push tab 56 facilitates removal of a refill unit from the housing 12 by providing an easy mechanism for overcoming the biasing force provided by the biasing spring 52 to unlock the release ring 48.

Figure 8:
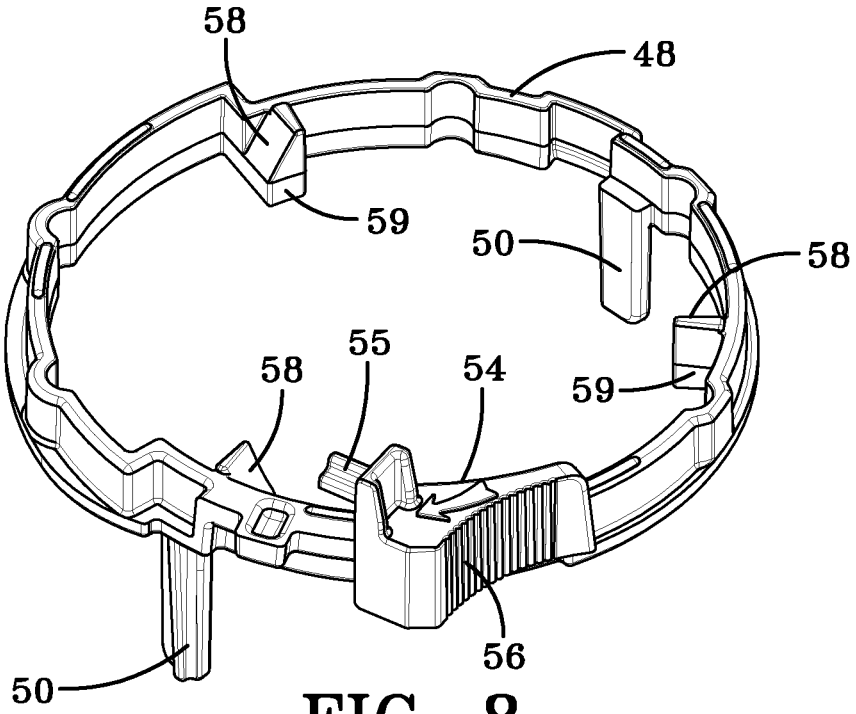
FIG. 8 is a bottom perspective view of a lock ring according to the concepts of the present invention.

The release ring 48 also includes a plurality of ramped surfaces 58 facing upwardly and away from the actuator 24. The number and spacing of the ramped surfaces 58 may vary. In the embodiment shown in the drawings three ramped surfaces 58 are shown and spaced approximately 120° apart around the circumference of the release ring 48. The ramped surfaces 58 may be formed in the release ring 48 in a variety of ways, as will be appreciated by those skilled in the art. A particular structure contemplated is shown in FIG. 8, where the ramped surfaces 58 are provided on radially inwardly extending projections 59 on an interior of the release ring 48.

This arrangement allows the ramped surface 58 to be positioned adjacent to or within the windows 45 in the support member 30.

A collar 60 of a refill unit encloses and surrounds the pump 40, which is adapted to dispense a product contained in a product reservoir (not shown), as is well known in the art. The collar 60 is received within the support member 30 when the refill unit is positioned within the housing 12. The piston 38 of the pump 40 extends through the opening 36 in the support member 30 to contact and engage the actuator 24. In one or more embodiments, the collar 60 may be generally cylindrical in shape.

Figure 9:
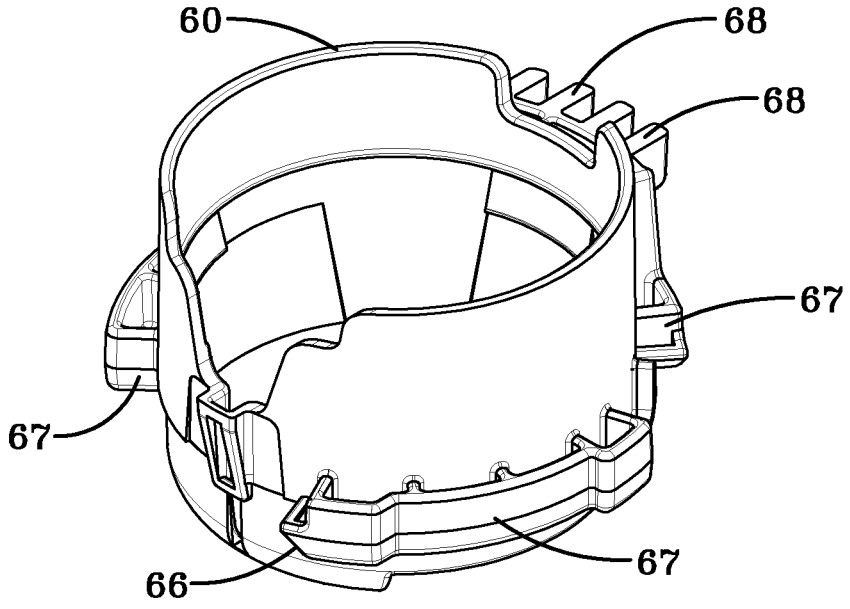
FIG. 9 is a top perspective view of a refill unit collar according to the concepts of the present invention.
Figure 10:
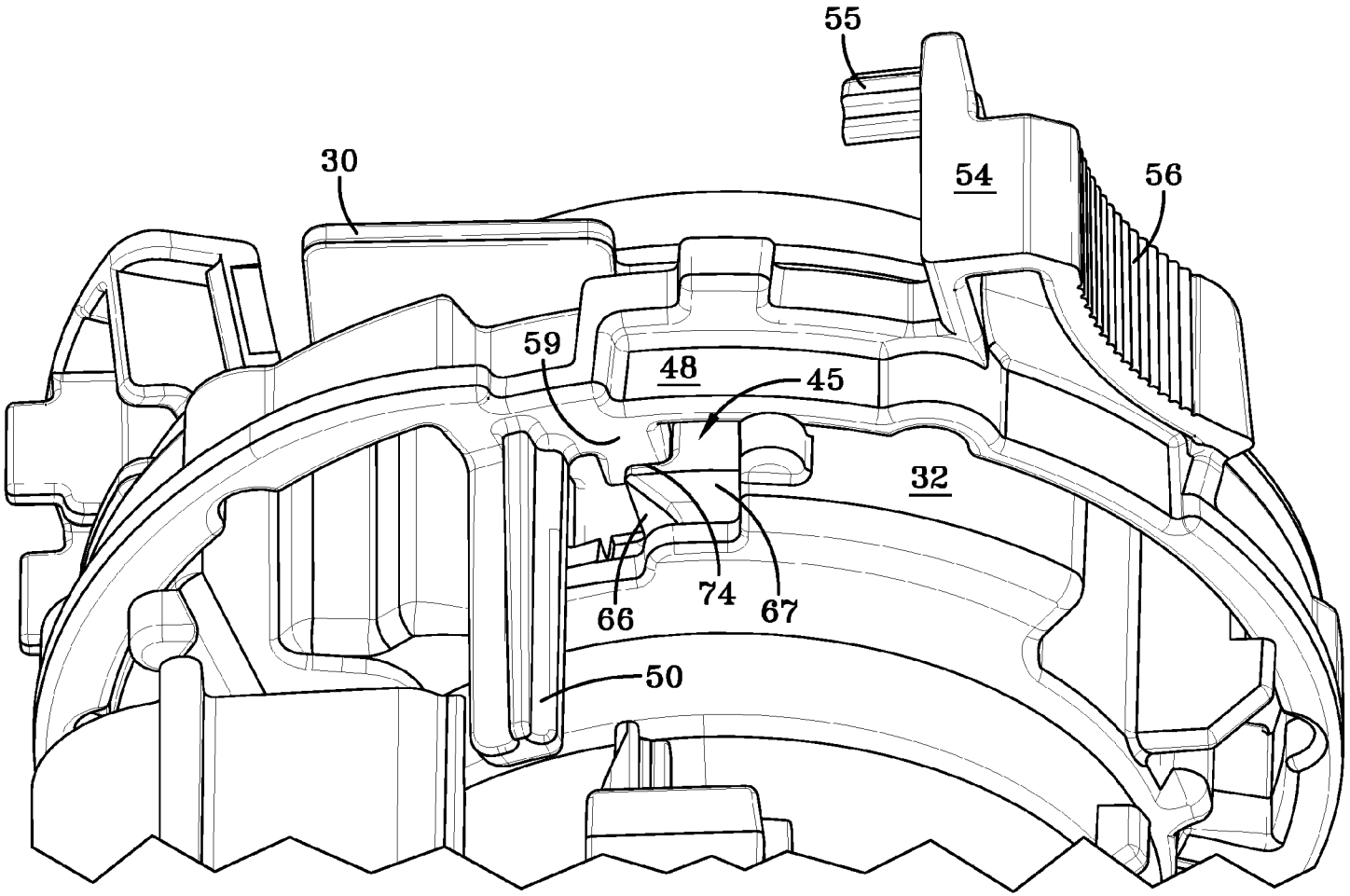
FIG. 10 is an enlarged perspective view of the sub-assembly of FIG. 4 showing the interaction of the ramped surface of the collar and release ring of the locking mechanism according to the concepts of the present invention.

The collar 60 includes a plurality of ramped surfaces 66 facing downwardly toward the actuator 24. The number and spacing of the ramped surfaces 66 on the collar 60 are preferably equal to the number and spacing of the ramped surfaces 58 on the release ring 48. Thus, in the embodiment shown in the drawings, three ramped surfaces 66 are provided on the collar 60 and are spaced approximately 120° apart on the outer circumference of the collar. The ramped surfaces 66 may be formed in the collar 60 in a variety of ways, as will be appreciated by those skilled in the art. A particular structure contemplated is shown in FIG. 9, where the ramped surfaces 66 are provided on radially outwardly extending projections 67 on an exterior of the collar 60. This arrangement allows the ramped surfaces 66 to be positioned adjacent to or within the windows 45 in the support member 30.

In one or more embodiments, the collar 60 may also include one or more outwardly extending fins or keys 68 that are received in notches or keyways 70 in the support member 30 or another portion of the backplate 14. The keys 68 and keyways 70 prevent rotation of the collar 60 relative to the support member 30, which ensures proper functioning of the locking mechanism, as will be discussed below.

In a locked position, when no refill unit is positioned within the housing 12, the locking posts 28 of the actuator 24 are aligned with the locking posts 50 of the release ring 48. In this locked position, actuation of the dispenser is prevented because the actuator 24 cannot move vertically within the housing 12 due to the interference between the locking posts 28 and 50. The biasing spring 52 maintains the release ring 48 in this locked position absent a force to overcome the biasing force, so that the dispensing system 10 is locked absent the presence of an approved refill unit.

Upon insertion of a refill unit with the collar 60 having the ramped surfaces 66, the dispensing system 10 is unlocked. The ramped surfaces 66 of the collar 60 contact and engage the ramped surfaces 58 of the release ring 48 to cause rotation of the release ring relative to the support member 30 and within recess 49. As will be appreciated by those skilled in the art, rotation of the release ring 48 moves the locking posts 50 out of engagement with the locking posts 28 of the actuator 24, thereby allowing vertical movement of the actuator 24 and actuation of the dispensing system 10.

When the collar 60 is fully inserted into the support member 30 the release ring 48 may be secured in an unlocked position by the projections 59 on the release ring 48 being received in lips 74 on the collar 60. The projections 59 and lips 74 maintain the release ring 48 in an unlocked position to allow repeated actuation of the pump 40 while the refill unit and the collar 60 remain within the housing 12. The windows 45 in support member 30 allow engagement of the ramped surfaces 66 and 58 despite the intervening structure of the support member 30. To remove the refill unit and the collar 60, the push tab 56 may be pressed toward the backplate 14, thereby overcoming the biasing force of the spring 52 and rotating the release ring 48 out of engagement with the collar 60. Upon release of the push tab 56 the release ring will return to a locked position to prevent actuation of the dispensing system 10 until another authorized refill unit is inserted.

It is thus evident that lockout mechanism constructed as described herein substantially improves the art. In accordance with the Patent Statutes, only the best mode and preferred embodiment have been presented and described in detail. The invention should not be limited by the drawings or the description provided herein. For an appreciation of the true scope and breadth of the invention, reference should be made only to the following claims.

What is claimed is:

1. A dispensing system comprising:

a housing:

an actuator slidably secured within the housing and including at least one locking post extending therefrom, the actuator adapted to actuate a pump to cause dispensing of a product; and a release ring rotatably secured within the housing and including at least one locking post extending therefrom and aligned with the locking post of the actuator, and at least one ramped surface, wherein the locking posts of the actuator and release ring engage one another in a locked position to prevent actuation of the dispensing system, and where the release ring is adapted to be rotated to an unlocked position upon insertion of an authorized refill unit.

2. The dispensing system of claim 1, where the housing includes a pivotable pushbar engaged with the actuator.

3. The dispensing system of claim 1, wherein the release ring includes three ramped surfaces spaced around the outer circumference of the release ring.

4. The dispensing system of claim 1, wherein the actuator includes two laterally spaced locking posts.

5. The dispensing system of claim 4, wherein the release ring includes two diametrically opposed locking posts, each locking post of the release ring being aligned with a locking post of the actuator.

6. The dispensing system of claim 1, further comprising a biasing spring that biases the release ring in a locked position.

7. The dispensing system of claim 1, wherein the actuator is adapted to actuate a pump when moved.

8. The dispensing system of claim 1, wherein the release ring is generally annular.

9. A product dispensing system comprising:

a housing;

an actuator movably secured within the housing and having a locking post extending therefrom, the actuator adapted to actuate a pump to cause dispensing of a product;

a release ring rotatable between a locked position and an unlocked position, the release ring including a locking post extending therefrom that is aligned with the locking post of the actuator in a locked position, and a ramped surface; and a collar of a refill unit including a ramped surface that, upon insertion into the housing, engages the ramped surface of the release ring to cause rotation of the release ring from a locked position to an unlocked position.

10. The product dispensing system of claim 9, where the housing includes a pivotable pushbar engaged with the actuator.

11. The product dispensing system of claim 9, wherein the release ring includes three ramped surfaces spaced about the outer circumference of the release ring.

12. The product dispensing system of claim 9, wherein the actuator includes two or more locking posts.

13. The product dispensing system of claim 12, wherein the release ring includes the same number of locking posts as the actuator, each locking post extending from the release ring being aligned with a locking post extending from the actuator when the release ring is in the locked position.

14. The product dispensing system of claim 9, further comprising a biasing mechanism that biases the release ring in a locked position.

15. The product dispensing system of claim 9, wherein the release ring is generally annular.

16. The product dispensing system of claim 11, wherein the collar includes three ramped surfaces adapted to engage the ramped surfaces of the release ring.

17. The product dispensing system of claim 9, wherein the collar includes a key extending therefrom that is received in a keyway in the housing to prevent rotation of the collar relative to the housing and release ring.

* * * * *